US006552484B1

(12) United States Patent
Dasgupta

(10) Patent No.: US 6,552,484 B1
(45) Date of Patent: Apr. 22, 2003

(54) FINE ADJUSTMENT APPARATUS FOR ELECTRON BEAM DEFLECTION A CATHODE RAY TUBE

(75) Inventor: Basab Bijay Dasgupta, San Diego, CA (US)

(73) Assignees: Sony Corporation, Tokyo (JP); Sony Electronics Inc., Woodcliff Lake, NJ (US)

( * ) Notice: Subject to any disclaimer, the term of this patent is extended or adjusted under 35 U.S.C. 154(b) by 168 days.

(21) Appl. No.: 09/604,050

(22) Filed: Jun. 26, 2000

(51) Int. Cl.[7] ..... H01J 29/70; H01J 29/46

(52) U.S. Cl. ..... 313/440; 313/443; 313/420; 313/413

(58) Field of Search ..... 313/440, 443, 313/420, 413

(56) References Cited

U.S. PATENT DOCUMENTS 4,556,857 A * 12/1985 Logan ..... 313/431
5,408,159 A * 4/1995 Maillot et al. ..... 313/440
5,811,922 A * 9/1998 Yi ..... 313/440
6,373,180 B1 * 4/2002 Azzi et al. ..... 313/440

FOREIGN PATENT DOCUMENTS

JP 02210742 A * 8/1990 ..... H01J/29/76

* cited by examiner

*Primary Examiner*—Vip Patel
*Assistant Examiner*—Matt Hodges
(74) *Attorney, Agent, or Firm*—Fitch, Even, Tabin & Flannery

(57) ABSTRACT

Apparatus for displaying video images including a vacuum envelope which includes a neck portion and a display screen and an electron gun system. The electron gun system producing at least one electron beam, which in response to a magnetic field converges the at least one electron beam onto the display screen causing video images corresponding to the at least one electron beam to be displayed thereon. The apparatus further including a deflection yoke system for producing the magnetic field, the deflection yoke system comprising a plurality of electrical coils arranged such that a first magnetic field is formed and a second magnetic field is formed transverse to said first magnetic field, the deflection yoke system further including at least one conducting plate which includes magnetic field shaping features such that when said at least one conducting plate is electrically energized, the magnetic field is enhanced and balanced to compensate for undesired barrel distortion, pin-cushion distortion, and misconvergence errors. Alternatively, the deflection yoke system includes only a plurality of conducting plates which include magnetic field shaping features such that when the plurality of conducting plates are electrically energized, the magnetic field is produced.

20 Claims, 8 Drawing Sheets

FINE ADJUSTMENT APPARATUS FOR ELECTRON BEAM DEFLECTION A CATHODE RAY TUBE

TECHNICAL FIELD

The present invention relates to deflection yokes used to adjust electron beam deflection in cathode ray tubes. In particular, the present invention pertains to conductive plates which may be used to replace or augment the deflection yokes used in cathode ray tubes.

BACKGROUND OF THE INVENTION

The invention relates to cathode ray tube (CRT) apparatuses having a display screen, an electron gun system to generate at least one electron beam, and a deflection unit (or deflection yoke) for deflecting the electron beam(s) in accord with a changing pattern.

In monochrome CRT's the electron gun system generates one electron beam which is directed onto the display screen, whereas color display tubes use electron gun systems which generate three electron beams which converge on the display screen.

Referring to FIG. 1 which depicts a conventional cathode ray tube (CRT) apparatus including a vacuum envelope 10 which commonly resembles a trumpet shaped vacuum envelope having a narrow neck portion 12 and a wider portion which includes a display screen 14. Toward one end of the narrow neck portion 12 lies the electron gun system 16. At the opposite wider end of the envelope lies the display screen 14 which includes phosphorescent materials which radiate light when struck by electrons emitted from the electron gun system 16.

The deflection yoke 20, (also, referred to as a deflection system or deflection unit) commonly positioned about the narrow neck portion of the envelope, is designed to deflect the electron beam(s) emanating from the electron gun system 16. The deflection yoke 20 is used to deflect the electron beam from its normal undeflected straight path, so that the beam impinges upon selected points on the display screen 14 to provide visual presentations. By varying the magnetic (or deflection) fields created by the deflection yoke 20 in a suitable manner, the electron beam(s) can be deflected upwards or downwards and to the left or to the right over the display screen. By simultaneously modulating the intensity of the beam a visual presentation of information or a picture can be formed on the display screen. A common example is the display of video images.

In three beam electron gun systems 16 the three deflected beams which correspond to different colors (for example, red, green, and blue (RGB)) are deflected such that the three beams each converge at the display screen 14 to produce the appropriate color in a manner known to those having ordinary skill in the art.

The shape and intensity of the magnetic deflection fields created by a deflection yoke vary throughout the CRT and along a distance the electron beam must travel. One typical field pattern is known as a "barrel" field, an example of which is shown in FIG. 2 as a cross-section perpendicular to the CRT axis. As is well known in the art the field is called a "barrel" field because the separation between field lines 5 is greater near the center regions of the deflection field. The field depicted in FIG. 2 results in a so-called North/South (NS) distortion "pin-cushion of otherwise horizontal lines. Another common field pattern is the so-called "pin-cushion" field depicted in FIG. 3. As is also well known, the field is called a "pin-cushion" field because the separation between field lines 5 decreases near the center regions of the deflection field. The field depicted in FIG. 3 results in a so-called NS barrel distortion. These and other field variations are known and used by practitioners having ordinary skill in the art in the design and application of suitable deflection yoke's 20.

Many different coil configurations are used to establish the desired deflection field at each location within the vacuum envelope 10. Typical examples of coils known in the art are saddle coils (FIG. 4*a*), which are used in opposing pairs, and toroidal coils (FIG. 4*b*).

A common type of deflection yoke comprises two sets of deflection coils positioned about the display enabling deflection of the electron beam in two directions which are transverse to each other. By way of example, a first set of saddle coils uses two coils which are arranged on oppositely located sides of the neck portion of the vacuum envelope. Another set of saddle coils can be oriented relative to the first set of coils by orienting them at 90° about the neck portion of the vacuum envelope. Such an arrangement is commonly referred to as a saddle-saddle (or S-S) coil arrangement (after the "saddle" shape of the deflection coils). One set of coils (the vertical deflection coils), when energized deflects the electron beam in a first (vertical) direction. Another set of coils (the horizontal deflection coils), when energized deflects the electron beam in a direction transverse to the first direction. The sets of deflection coils upon energization, generate a dynamic magnetic multi-pole field comprising at least a dipole component and a multi-pole component. Alternatively, the vertical set of saddle coils may be replaced with a so-called toroidal coil to form a hybrid coil arrangement called a saddle-toroidal (or S-T) arrangement. Still other applications may not use saddle type coils at all, instead using pairs of toroidal coils (in a toroidal-toroidal (T-T) arrangement).

Using a saddle-saddle arrangement as an example, the two sets of deflection coils are energized to produce two substantially orthogonal deflection fields. Inside the vacuum envelope the fields are substantially perpendicular to the path of the undeflected electron beam(s). A cylindrical core, comprised of material having a very high relative permeability (e.g., on the order of 1000), positioned to closely engage the sets of deflection coils (in a saddle-saddle configuration) is used to concentrate deflection fields generated by the coils and to increase the flux density in a deflection area. Also, an insulating liner is positioned between the two sets of coils to prevent electrical shorting between the coils.

With continued reference to FIG. 1, a cross section view of a saddle-toroidal (S-T) configuration is shown. A vacuum envelope 10 including a neck portion 12, an electron gun system 16 for producing at least one electron beam, and a display screen 14 are shown. Also shown is a S-T type deflection yoke 20 including a pair of saddle deflection coils 21*a* & 21*b* positioned about the neck 12 of the envelope 10. The deflection yoke 20 also includes an electrical insulation layer 25 positioned between the saddle coils 21*a*, 21*b* and a toroidal coil 23. The toroidal coil 23 is commonly wrapped around a ferrite core 24.

In order to satisfy certain requirements regarding picture quality, the (dynamic) magnetic deflection fields are often strongly modulated. For example, as is known in the art, the stringent convergence requirements in three inline color television systems necessitate, different polarities and different magnitudes of magnetic multi-pole components along the axis of the yoke from gun side to screen side. "Line" field is synonymous with horizontal field because this field results in forming lines by pushing electrons from left to right on screen. "Field" is same as "vertical" because vertical deflection refreshes the whole field (i.e., whole screen) after all horizontal lines are scanned. Further, in systems where the electron beam(s) must negotiate a large deflection angle (such as in wide screen applications), it is particularly difficult to achieve the required deflection field modulations using only the two sets of deflection coils. In some cases this can only be achieved at very high cost, in other cases the required field modulation is simply not possible to achieve using two sets of coils.

Many approaches have been tried to solve the complex problem of adjusting the deflection field to achieve the desired field modulation at each point in the CRT. One approach has been to include a variety of "helpers" which modify the deflection field in ways which are not possible with present art deflection coils alone within the given time frame or cost constraints. Typical helpers are small permanent magnets, (e.g., U.S. Pat. No. 4,396,897) small or large pieces of permeable material placed in specific locations, or the use of auxiliary coils.

What is needed is a low cost, easily manufacturable, highly sensitive method and apparatus for modulating the deflection field in a CRT. Also needed is a replacement for the many "helpers" currently used to modulate the deflection field. What is also needed is an easily manufacturable low cost replacement for the conventional coil systems currently used to control the deflection field in a CRT.

SUMMARY OF THE INVENTION

In one embodiment the present invention can be characterized as a system that displays video images comprising a cathode ray tube means including an electron gun system for producing at least one electron beam, which in response to a magnetic field converges onto a display screen causing video images corresponding to the at least one electron beam to be displayed thereon; and a deflection yoke means for producing the magnetic field, the deflection yoke means comprising a plurality of electrical coils arranged such that when said plurality of coils are energized a line or horizontal deflection field is formed and a field or vertical deflection field is formed transverse to said line deflection field, the deflection yoke further including at least one conducting plate which includes therein one or more magnetic field shaping features such that when the at least one conducting plate is electrically energized, the magnetic field is enhanced and balanced to compensate for at least one of undesired barrel distortion, pin-cushion distortion, and misconvergence errors. The inventors further contemplate embodiments where in the electron gun system produces a plurality of electron beams, including electron gun systems which produce three electron beams, each corresponding to a respective color wherein, in response to the magnetic field, the electron beams converge onto the display screen producing color video images corresponding to the converged electron beams.

The invention further contemplates conducting plate embodiments which include magnetic field shaping features. In one conducting plate embodiment the field shaping features include a slit extending along a length of the conducting plate. A further embodiment includes a conducting plate having a length, a rear end, and a front end wherein the field shaping features include having at least one slot in the conducting plate, the at least one slot being oriented transverse to the length of the conducting plate. Or alternatively, the field shaping features may include having two slots, a first slot positioned near the rear end of the conducting plate and a second slot positioned near the front end of the conducting plate and wherein the first slot and the second slot are each oriented transverse to the length of the conducting plate. A further embodiment includes a conducting plate having a plurality of apertures formed therein. Another embodiment includes a conducting plate wherein the field shaping features included having apertures in the conducting plate including a slot extending a distance along a length of the conducting plate. In another embodiment the conducting plate has a length, a rear end, and a front end, and wherein the conducting plate includes an opening having an increasing angular width from the front end to the rear end.

Another embodiment includes a vacuum envelope having a neck portion and a display screen and having a electron gun system for producing at least one electron beam wherein, in response to a magnetic field, the at least one electron beam converges onto the display screen causing video images corresponding to at least one electron beam to be displayed thereon and also including a deflection yoke for producing the magnetic field. The deflection yoke comprises at least one conducting plate which when electrically energized forms the magnetic field.

In a further embodiment an apparatus for displaying video images comprises a vacuum envelope including a neck portion and a display screen an electron gun system for producing a plurality of electron beams each corresponding to a respective color and, in response to a magnetic field, for converging the electron beams onto the display screen causing video images corresponding to the converged electron beams to be displayed thereon. This embodiment includes a deflection yoke comprising a plurality of conducting plates including magnetic field shaping features, the conducting plates when electrically energized form the magnetic field which converges the electron beams onto the display screen.

Other features of the present invention are disclosed or made apparent in the section entitled "DETAILED DESCRIPTION OF THE PREFERRED EMBODIMENTS.

BRIEF DESCRIPTION OF THE DRAWINGS

For a fuller understanding of the present invention, reference is made to the accompanying drawings in the following Detailed Description of the Invention. Reference numbers and letters refer to the same or equivalent parts of the invention throughout the several figures of the drawings. In the drawings.

DETAILED DESCRIPTION OF THE PREFERRED EMBODIMENTS

Figure 5:
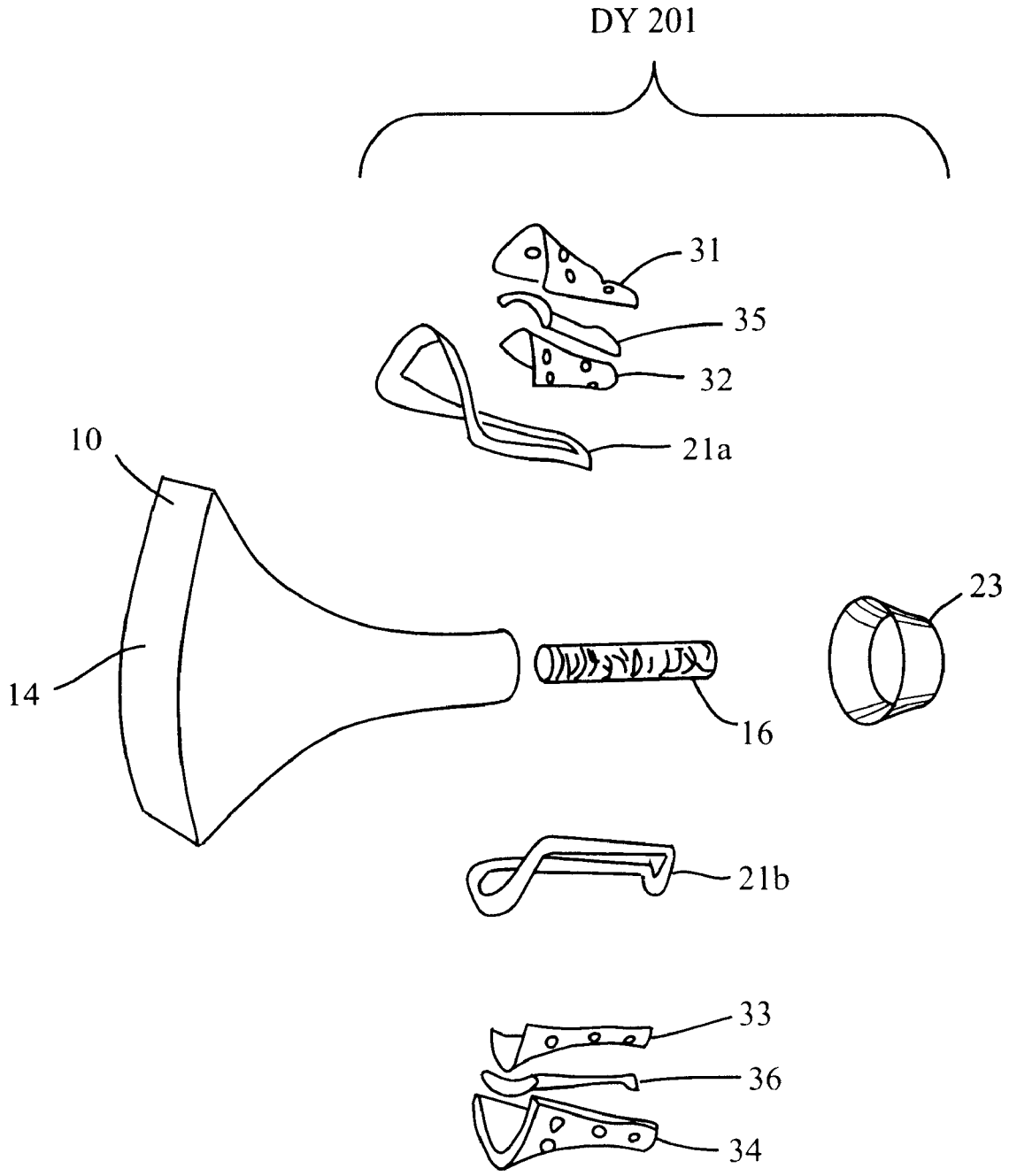
FIG. 5 is an exploded view of an embodiment using a plurality of conducting plates in accordance with the principles of the present invention.

FIG. 5 is an illustration of an embodiment constructed in accordance with principles of the present invention which is shown as an exploded view of a CRT apparatus. The pictured embodiment shows a conventional vacuum envelope (or tube) 10 including, on one end, a display screen 14, and on an opposite end a narrower neck portion 12 which includes therein an electron gun system 16 (e.g., a one or three gun system). Also shown is an embodiment of a deflection yoke 201 constructed in accordance with principles of the present embodiment.

Figure 1:
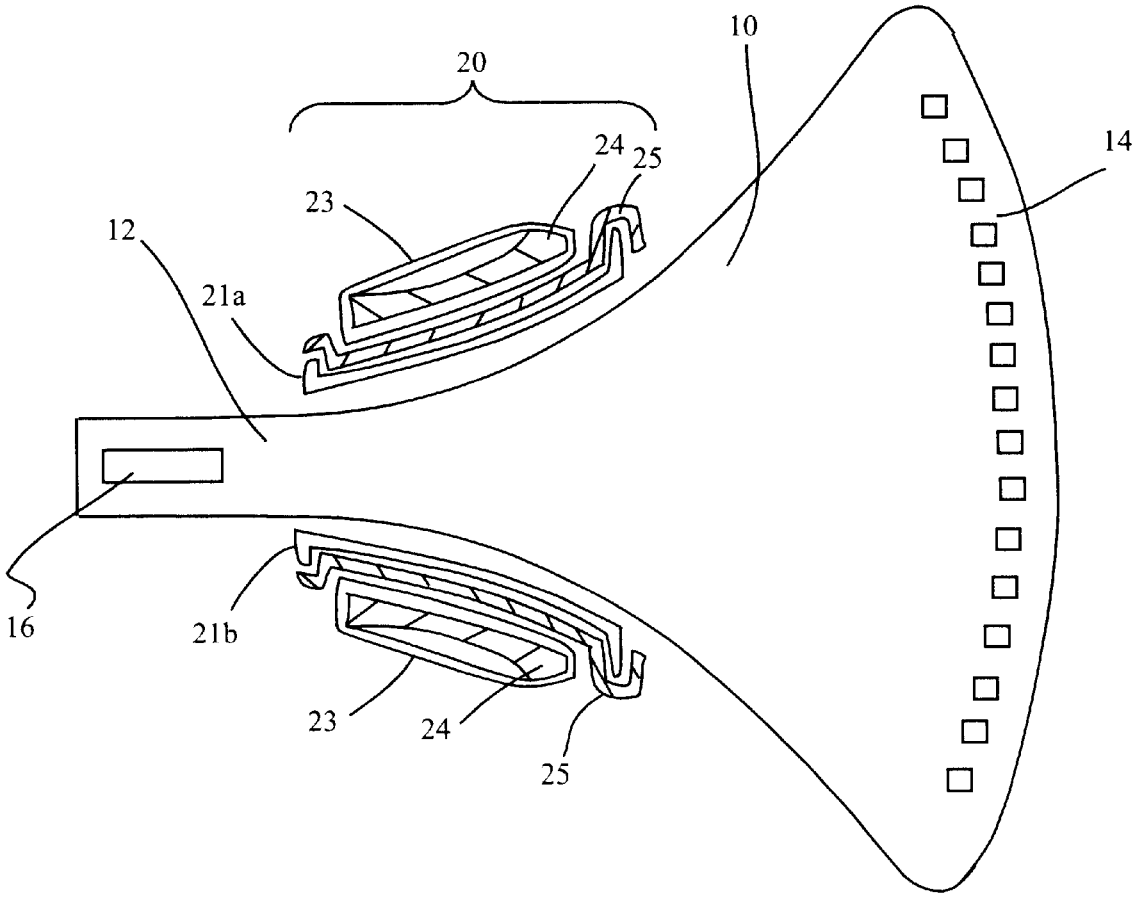
Fig. 1 (Prior Art)
FIG. 1 is a cross-section view of a conventional cathode ray tube (CRT).
Figure 2:
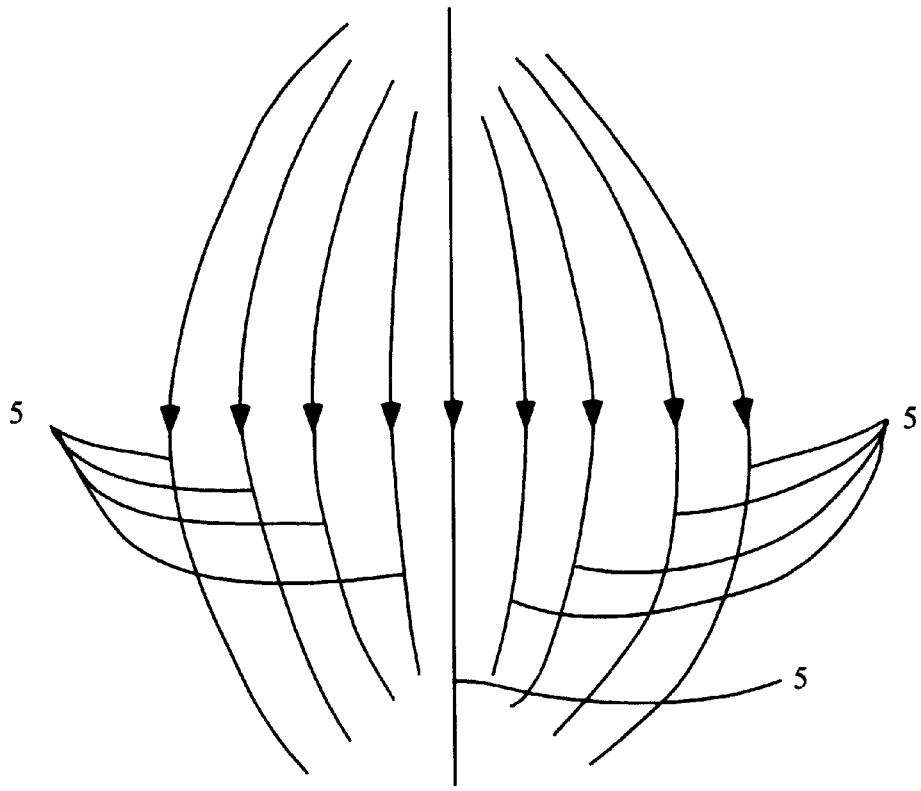
FIG. 2 is a schematic illustration depicting the electromagnetic field lines of a "barrel" field.
Figure 3:
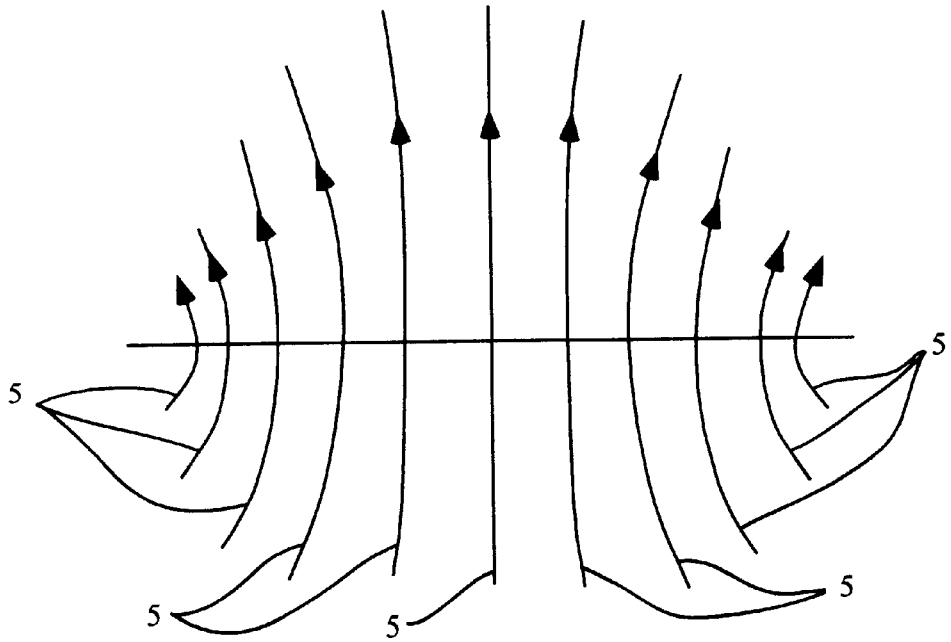
FIG. 3 is a schematic illustration depicting the electromagnetic field lines of a "pin-cushion" field.
Figure 4A:
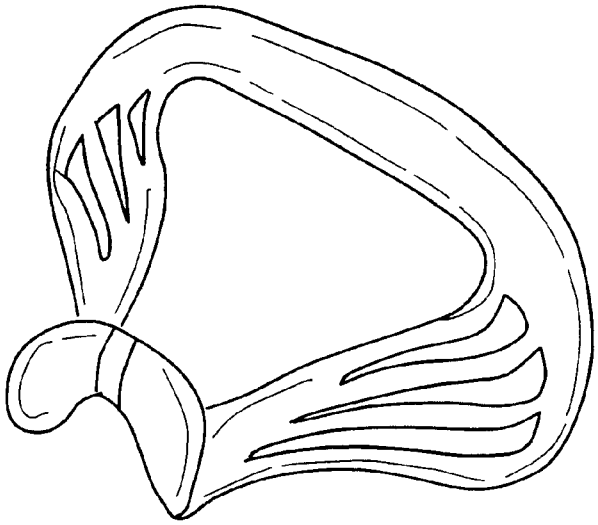
Fig. 4A (Prior Art)
FIGS. 4(*a*) and 4(*b*) are examples of saddle and toroidal deflection coils.
Figure 4B:
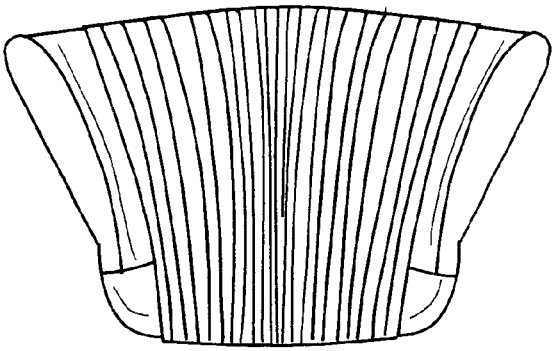
Fig. 4B (Prior Art)

The CRT and most portions of the deflection yolk 201 may be configured and arranged in a manner substantially similar to that of the CRT apparatus and deflection yolk of FIG. 1. Accordingly, only a brief description of these elements, including any differences therebetween will be presented herein.

The pictured embodiment shows a deflection yolk 201 including a pair of saddle coils 21*a*, 21*b*, two sets of conducting plates 31, 32, 33, 34, electrically insulating separators 35, 36 and a toroidal coil 23.

In one embodiment a pair of saddle-type coils 21*a*, 21*b* are positioned around the neck portion 12 of the vacuum envelope 10 in conjunction with a toroidal coil 23 in order to properly affect the deflection of electron beams emitted from the electron gun 16.

The vacuum envelope or tube 12 may be fabricated from glass or alternatively a ceramic material, a metal-like material or similar such materials. The vacuum envelope 12 can be for example a COTY (combined optimum tube and yolk) funnel, wherein, the electron gun system 16 may be arranged in a manner similar to that in the CRT apparatus of FIG. 1. (The COTY funnel refers to an industry standard COTY funnel.) Such electron gun systems 16 include COTY or "TRINITRON" electron gun systems. The display screen 14 may have a substantially cylindrical shape and a relatively flat surface. For example, COTY funnel model number SD268 manufactured by Techneglas Corp. may be used with a SD268 panel or screen manufactured by the Techneglas Corp.

The deflection yoke 201 embodiment may include a pair of shaped coil members, such as the two saddle shaped coil members 21*a* and 21*b*, and a toroidal coil 23 which is wound about a core formed of a high permeance material (e.g., ferrite), the toroidal coil fitting around the pair of lined deflection coils. This basic deflection unit is enhanced by the presence of a plurality of conducting plates (31, 32, 33, 34) defined and shaped to enhance the deflection field. For example, in the embodiment pictured in FIG. 5 includes four conducting plates 31, 32, 33, and 34 are positioned in two stacks (or sets)about the neck portion 12 of the vacuum envelope 10. In the embodiment shown the conducting plates (31, 32, 33, 34) are positioned around the deflection coils 21*a* and 21*b* as shown. Appropriate separators (35, 36) are placed between conducting plates (31, 32, 33, 34). Additionally, each of the conducting plates are electrically insulated from other conducting components, e.g., using insulating separators or by coating the conducting plates (31, 32, 33, 34) with an electrically insulating material. The main purpose of such insulators or separators is to provide electrical insulation between the aforementioned components to prevent them from shorting out against one another in use.

It should be noted that although four conducting plates are used with the embodiment pictured in FIG. 5, fewer conducting plates may be used. In fact, one, appropriately constructed, shaped, and positioned conducting plate could be used to accomplish the objectives of the present embodiment. Additionally, many more conducting plates could be used to accomplish the objectives of the present embodiment. In fact many different conducting plates, can be stacked onto a cathode ray tube apparatus to modulate the deflection field. Additionally, a plurality of different conducting plates, each having specific shapes directed toward modulating the deflection field in a specific way, could be used to adjust the deflection field in accordance with the needs of a CRT design engineer. In addition to applications using saddle-toroidal hybrid deflection yoke's the conducting plates can also be used in conjunction with saddle-saddle type deflection yoke's or toroidal-toroidal type deflection yoke's. In fact, the inventors' contemplate that with appropriate design the conducting plates can be used to replace coils altogether as a means of adjusting the deflection field.

Figure 6:
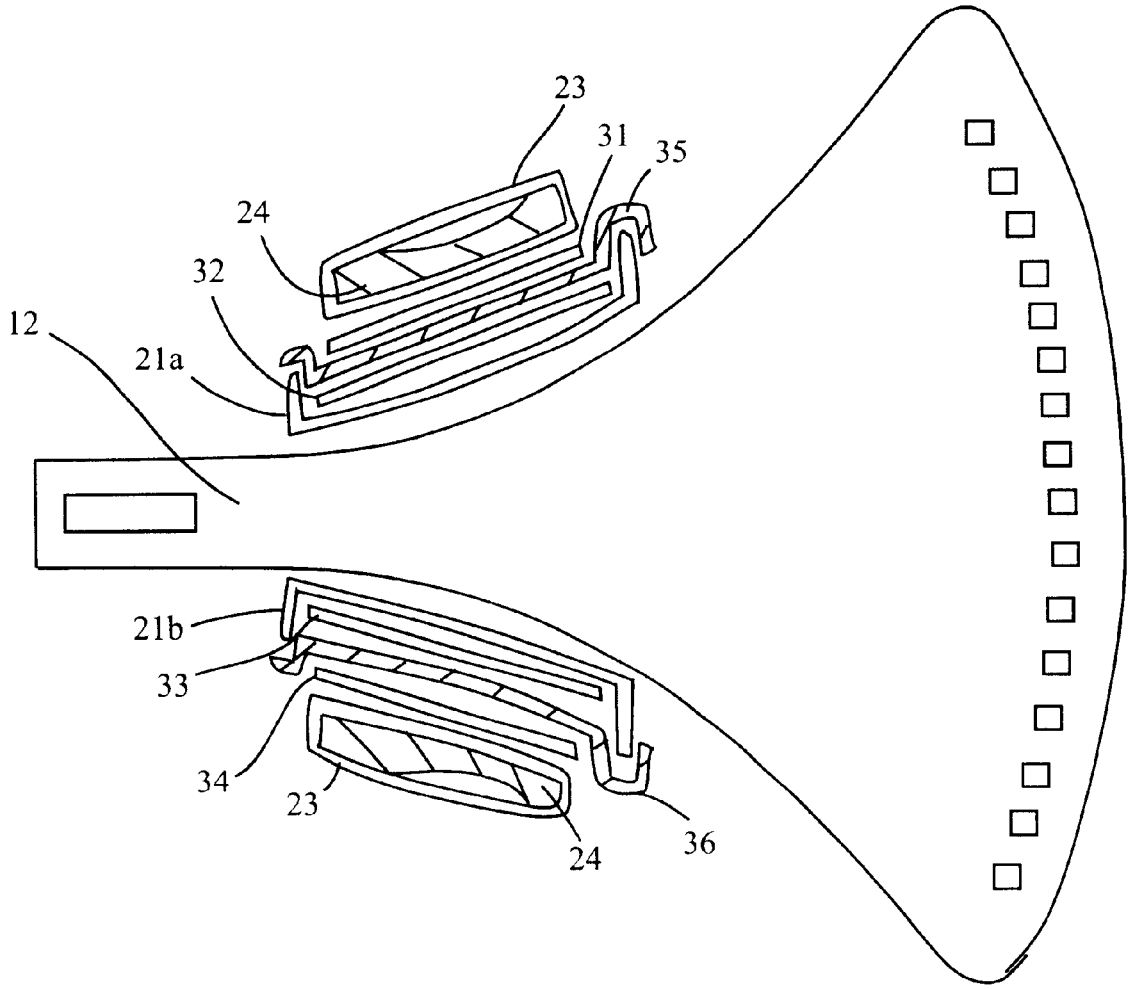
FIG. 6 is a cross-section view of an embodiment using a plurality of conducting plates in accordance with the principles of the present invention.

FIG. 6 shows a cross section view of one embodiment of the present invention showing the relationship between the deflection yoke 201 components and the vacuum envelope 10 (especially the neck portion 12). The saddle coils 21*a*, 21*b* are positioned next to the neck portion 12 of the vacuum envelope. A first set of conducting plates 32, 33 is positioned next to the saddle coils 21*a*, 21*b*. Electrically insulating separators 35, 36 are positioned to prevent electrical contact between the saddle coils 21*a*, 21*b* and the toroidal coil, as well as between the first set of conducting plates 32, 33 and the second set of conducting plates 31, 34. In most cases the conducting plates (e.g., 31, 32, 33, 34) are shaped to conform to the outer surface of the vacuum envelope 10 in the region where the conducting plates are to be positioned. The conducting plates (e.g., 31, 32, 33, 34) can also have one or more magnetic field shaping features. Examples of some embodiments including exemplar magnetic field shaping features are discussed below in the discussions of FIGS. 7A–7F. The saddle coils 21*a*, 21*b* and the conducting plates 31, 32, 33, 34 are encompassed by a toroidal coil 23 which is wound about a core 24 of material having a high magnetic permeability.

Figure 7A:
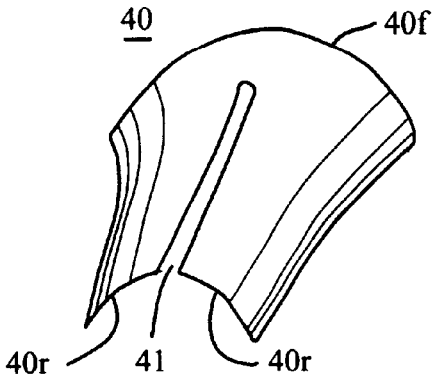
FIGS. 7A–7F are perspective views of a conducting plates which embody aspects of the present invention.

Referring to FIG. 7A, an embodiment of the present invention is formed of a plate of conducting material 40 which includes a front end 40*f* and a rear end 40*r*, the plate being positioned such that the front end 40*f* is nearest the display screen end of the vacuum envelope and the rear end 40*r* being positioned nearest the electron gun end of the vacuum envelope.

Figure 8:
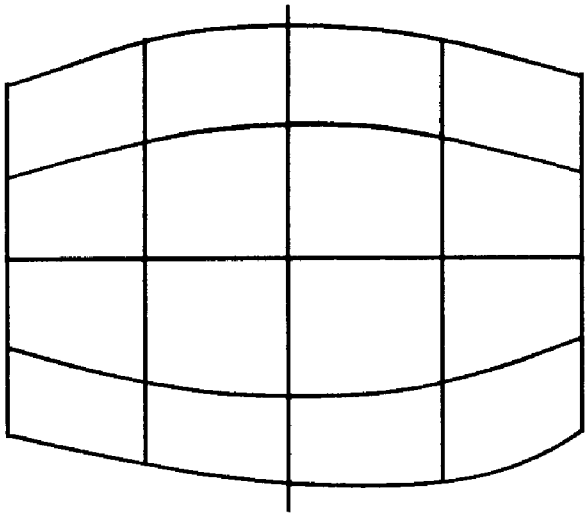
FIGS. 8 & 9 depict raster distortion and the type of correction possible with embodiments of the present invention.
Figure 9:
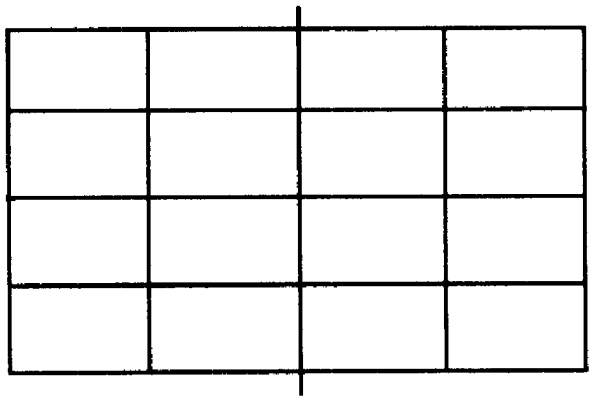

The conducting plate 40 includes a magnetic field shaping feature embodied by a narrow slit 41 that extends along a substantial portion of the entire length of the conducting plate 40. A preferred conducting plate 40 is formed of copper and is about 0.3 to 0.05 mm thick. Such an embodiment modulates the deflection field by enhancing the barrel field through out the entire deflection field of an associated coil. As a result raster distortion such as that shown in FIG. 8 can be corrected. By using the conducting plate 40 the magnetic field can be modulated to correct the raster distortion producing a raster pattern more like that shown in FIG. 9.

Figure 7B:
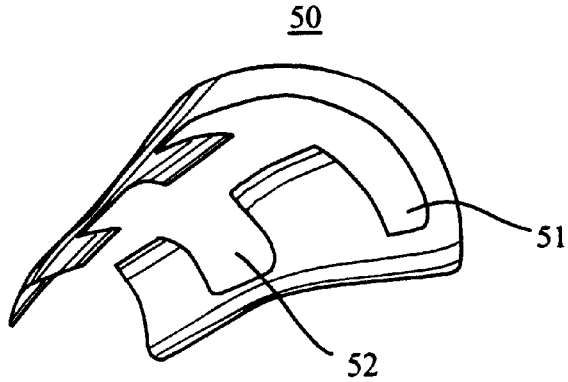

In another embodiment constructed in accordance with the principals of the present invention, as shown in FIG. 7B, a conducting plate 50 includes magnetic field shaping features embodied by two slots 51 and 52. A first slot 51 is positioned near the front end of the plate and a second slot 52 is positioned near the rear end of the conducting plate. Both slots feature large angular widths in the range of about 120° to about 150°. These two slots 51 and 52 enhance the pin-cushion shape of the deflection field near the front of the vacuum envelope and near the rear of the vacuum envelope but have only a small effect on the deflection field in the region between the two slots. Such field shaping is necessary for vertical field when the goal is to correct side (or E/W) pin-cushion distortion and all misconvergence errors (including those between red/blue and green) at the same time.

Figure 7C:
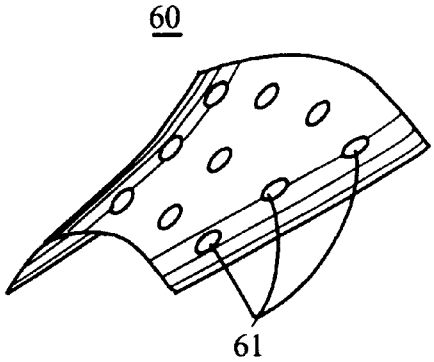
Figure 7D:
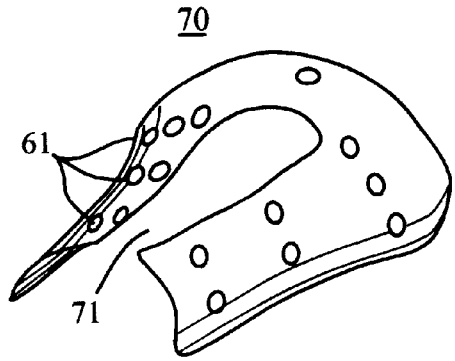

With reference to FIG. 7C another embodiment of the present invention is pictured. The embodiment includes a conducting plate 60 having magnetic field shaping features embodied by a series of apertures 61 placed at specific locations (i.e., at specific angles about the vacuum envelope) in order to enhance specific multi-pole components of the deflection field. The apertures may take on a variety of shapes with substantially circular or substantially ellipsoid apertures being preferred. In addition, a related embodiment (FIG. 7D) 70 includes a top groove 71 which enhances the barrel field in certain regions in the deflection field. In general, holes can be placed at angles where multi-pole fields are strongest or weakest. For six-pole field, such angles are 30°, 60°, 90° . . . etc. (from horizontal axis); for ten-pole field, appropriate angles are 18°, 36°, 54° . . . etc.

Figure 7E:
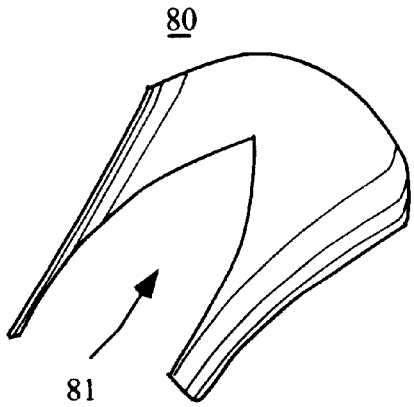

A still further embodiment is set forth in FIG. 7E. A conducting plate 80 includes a magnetic field shaping feature embodied by an opening 81 having an increasing angular width from front to rear. As a result the pin-cushion shape becomes more enhanced at the rear of the plate 80 (this enhances the pin-cushion field in the vacuum envelope nearest the electron gun system) and the barrel shape is more enhanced at the front of the plate 80 (thereby enhancing the barrel field in the region of the vacuum envelope nearest the display screen).

Figure 7F:
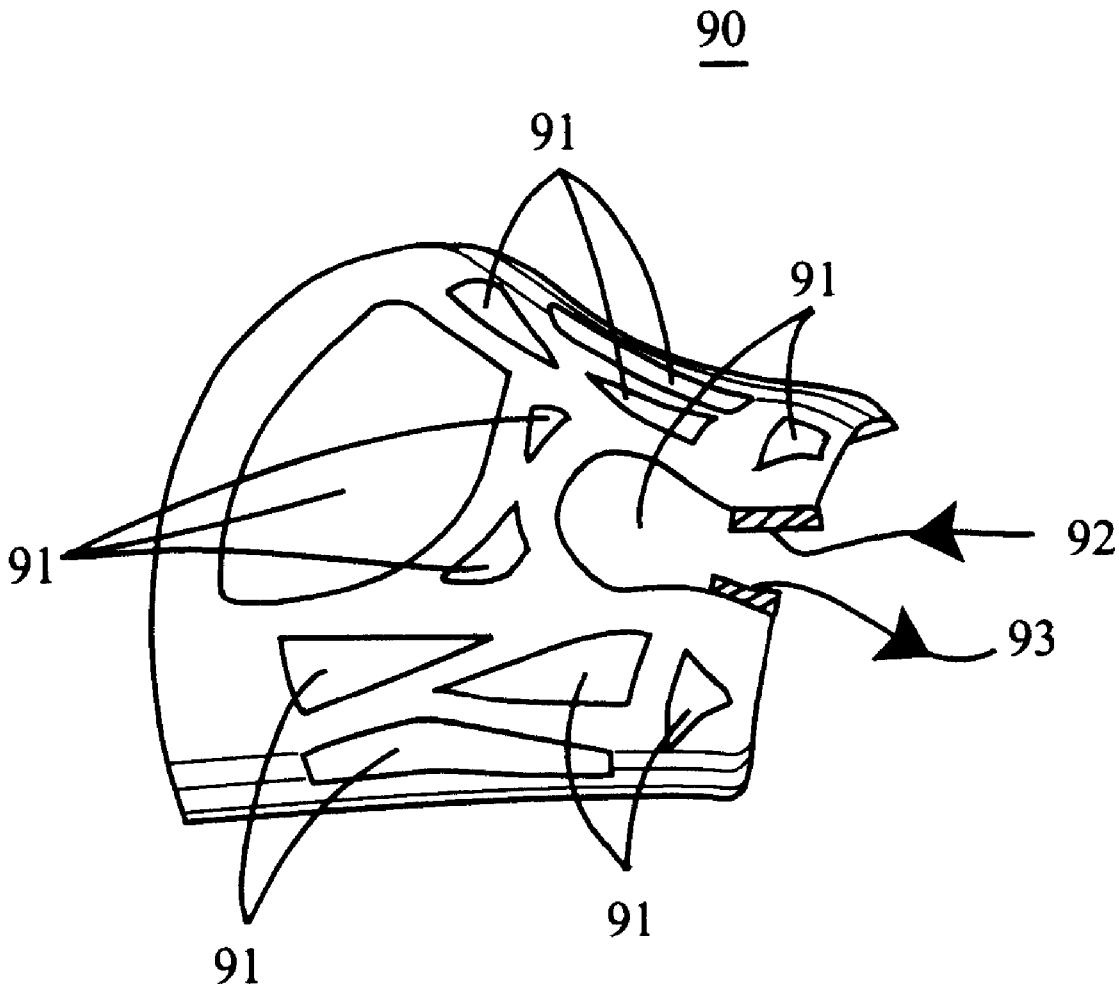

Another more complex embodiment is shown in FIG. 7F. This embodiment demonstrates the elaborate geometries possible using the principles of the present invention. A plate of conducting material 90 contoured to fit on a cathode ray tube is provided and a pattern of magnetic field shaping features 91 are formed on/in the plate 90. Also shown are locations 92, 93 on the plate where current can be passed through the plate to energize it. Such complex patterns can be used to create magnetic patterns not achievable in coils at anything approaching a reasonable cost. These patterns can derived using computer simulations or through the application of empirical approachs or both. The objective of such patterns is to achieve magnetic deflection fields to optimize electron beam convergence geometries.

These and other embodiments of the present invention can replace the small magnets, auxiliary coils, high permeance materials, and other devices used to affect the deflection field.

A still further advantage of the present invention is the very low cost of manufacturing the conducting plates in accordance with the principles and embodiments of the present invention. Thin plates of copper material can be supplied to a mass production process wherein desired patterns can be cut into the unprocessed plates. The typical example of such a process would be to provide a stack of many conducting plates to a stamping machine which would stamp appropriate patterns into the conducting plates. The plates can then be bent into a precise conformation and incorporated into CRT design. For example, the plates can be shaped to substantially conform to a neck portion of a CRT to which they will be fitted. Alternatively, plates of conducting material can be cut into the desired pattern using a laser or a water knife (e.g., using a process set forth in U.S. Pat. No. 4,555,872). Other methods commonly known to those with ordinary skill in the art could easily be used or adapted to shape the conducting plates into the needed configurations. The conducting plates of the present invention provide a low cost easily manufacturable replacement for (or addition to) auxiliary coils, permanent magnets, and materials having high permeability currently used to adjust the deflection field of a CRT.

Another advantageous implementation of the embodiments of the present invention is the replacement of deflection yoke coils altogether. Stacks (or even individual conducting plates) of conducting plates may be positioned about a conventionally constructed vacuum envelope in place of coils. When energized these plates can induce the needed deflection field without the need for coils. Because conducting plates can have large currents passed through them, and because conducting plates are cheaply manufactured, especially when compared to carefully wound saddle type coils, they present an attractive alternative to deflection coils. Furthermore, because of their ease of manufacture (especially in complicated shapes) in shapes not easily formed in coils, conducting plates are an attractive alternative where complicated deflection field patterns are desired.

The present invention has been particularly shown and described with respect to certain preferred embodiments and features thereof. It is to be understood that the shown embodiments are the presently preferred embodiments of the present invention and as such are merely representative of the subject matter broadly contemplated by the inventors. The scope of the invention fully encompasses other embodiments, as well as other embodiments which may become obvious to those skilled in the art, and is accordingly limited by nothing other than the appended claims, in which reference to an element in the singular is not intended to mean "one and only one" unless explicitly stated, but rather "one or more". All structural and functional equivalents of the elements of the above-described preferred embodiment that are known or later come to be known to those of ordinary skill in the art are expressly incorporated herein by reference and are intended to be encompassed by the present claims. Moreover, it is not necessary for a device or method to address each and every problem solved by the present invention, for it to be encompassed by the present claims. Furthermore, no element, component, or method step in the present disclosure is intended to be dedicated to the public regardless of whether the element, component, or method step is explicitly recited in the claims.

I claim:

1. An apparatus for displaying video images, the apparatus comprising:

cathode ray tube means including a electron gun system for producing at least one electron beam, which in response to a magnetic field converges the at least one electron beam onto a display screen causing video images corresponding to the at least one electron beam to be displayed thereon; and deflection yoke means for producing said magnetic field which includes a line deflection component and a field deflection component, the deflection yoke means comprising a plurality of electrical coils arranged such that the line deflection component is formed and the field deflection component is formed transverse to said line deflection component, the deflection yoke means further including at least one conducting plate having a length and having a rear end and a front end wherein said at least one conducting plate further comprises at least one slot oriented transverse to said length of said at least one conducting plate such that, when said at least one conducting plate is electrically energized, the magnetic field is enhanced.

2. An apparatus for displaying video images, the apparatus comprising:

cathode ray tube means including a electron gun system for producing at least one electron beam, which in response to a magnetic field converges the at least one electron beam onto a display screen causing video images corresponding to the at least one electron beam to be displayed thereon; and deflection yoke means for producing said magnetic field which includes a line deflection component and a field deflection component, the deflection yoke means comprising a plurality of electrical coils arranged such that the line deflection component is formed and the field deflection component is formed transverse to said line deflection component, the deflection yoke means further including at least one conducting plate having a length and having a rear end and a front end wherein said at least one conducting plate further comprises two slots, a first slot positioned near the rear end of said conducting plate and a second slot positioned near the front end of said conducting plate and wherein said first slot and said second slot are each oriented transverse to said length of said at least one conducting plate such that, when said at least one conducting plate is electrically energized, the magnetic field is enhanced.

3. An apparatus for displaying video images, the apparatus comprising:

cathode ray tube means including a electron gun system for producing at least one electron beam, which in response to a magnetic field converges the at least one electron beam onto a display screen causing video images corresponding to the at least one electron beam to be displayed thereon; and deflection yoke means for producing said magnetic field which includes a line deflection component and a field deflection component, the deflection yoke means comprising a plurality of electrical coils arranged such that the line deflection component is formed and the field deflection component is formed transverse to said line deflection component, the deflection yoke means further including at least one conducting plate comprising a slot extending a distance along a length of said at least one conducting plate such that, when said at least one conducting plate is electrically energized, the magnetic field is enhanced.

4. An apparatus for displaying video images, the apparatus comprising:

cathode ray tube means including a electron gun system for producing at least one electron beam, which in response to a magnetic field converges the at least one electron beam onto a display screen causing video images corresponding to the at least one electron beam to be displayed thereon; and deflection yoke means for producing said magnetic field which includes a line deflection component and a field deflection component, the deflection yoke means comprising a plurality of electrical coils arranged such that the line deflection component is formed and the field deflection component is formed transverse to said line deflection component, the deflection yoke means further including at least one conducting plate having a length and having a rear end and a front end wherein said at least one conducting plate further comprises an opening, the opening having an increasing angular width from said front end to said rear end when said at least one conducting plate is electrically energized, the magnetic field is enhanced.

5. An apparatus for displaying video images, the apparatus comprising:

cathode ray tube means including a electron gun system for producing at least one electron beam, which in response to a magnetic field converges the at least one electron beam onto a display screen causing video images corresponding to the at least one electron beam to be displayed thereon; and deflection yoke means for producing said magnetic field which includes a line deflection component and a field deflection component, the deflection yoke means comprising a plurality of electrical coils arranged such that the line deflection component is formed and the field deflection component is formed transverse to said line deflection component, the deflection yoke means further including at least one conducting plate having a length and having a rear end and a front end wherein said at least one conducting plate further comprises an opening having an increasing angular width from said front end to said rear end wherein said at least one conducting plate enhances a pin cushion shape of said magnetic field at the rear end of the at least one conducting plate and wherein said at least one conducting plate enhances a barrel shape of said magnetic field at the front end of the at least one conducting plate when said at least one conducting plate is electrically energized.

6. An apparatus for displaying video images, the apparatus comprising:

cathode ray tube means including a electron gun system for producing three electron beams each corresponding to a respective color which in response to a magnetic field converges the electron beams onto the display screen causing video images corresponding to the converged electron beams; and deflection yoke means for producing said magnetic field which includes a line deflection component and a field deflection component, the deflection yoke means comprising a plurality of electrical coils arranged such that the line deflection component is formed and the field deflection component is formed transverse to said line deflection component, the deflection yoke means further including at least one conducting plate having a length and having a rear end and a front end wherein said at least one conducting plate further comprises at least one slot oriented transverse to said length of said at least one conducting plate such that, when said at least one conducting plate is electrically energized, the magnetic field is enhanced.

7. An apparatus as in claim 6 wherein said at least one conducting plate includes having two slots, a first slot positioned near the rear end and a second slot positioned near the front end and wherein said first slot and said second slot are each oriented transverse to said length.

8. An apparatus for displaying video images, the apparatus comprising:

cathode ray tube means including a electron gun system for producing three electron beams each corresponding to a respective color which in response to a magnetic field converges the electron beams onto the display screen causing video images corresponding to the converged electron beams; and deflection yoke means for producing said magnetic field which includes a line deflection component and a field deflection component, the deflection yoke means comprising a plurality of electrical coils arranged such that the line deflection component is formed and the field deflection component is formed transverse to said line deflection component, the deflection yoke means further including at least one conducting plate comprising a slot extending a distance along a length of said at least one conducting plate such that, when said at least one conducting plate is electrically energized, the magnetic field is enhanced.

9. An apparatus for displaying video images, the apparatus comprising:

cathode ray tube means including a electron gun system for producing three electron beams each corresponding to a respective color which in response to a magnetic field converges the electron beams onto the display screen causing video images corresponding to the converged electron beams; and deflection yoke means for producing said magnetic field which includes a line deflection component and a field deflection component, the deflection yoke means comprising a plurality of electrical coils arranged such that the line deflection component is formed and the field deflection component is formed transverse to said line deflection component, the deflection yoke means further including at least one conducting plate having a length, having a rear end, and having a front end wherein said at least one conducting plate includes an opening having an increasing angular width from said front end to said rear end such that, when said at least one conducting plate is electrically energized, the magnetic field is enhanced.

10. An apparatus for displaying video images, the apparatus comprising:

cathode ray tube means including a electron gun system for producing three electron beams each corresponding to a respective color which in response to a magnetic field converges the electron beams onto the display screen causing video images corresponding to the converged electron beams; and deflection yoke means for producing said magnetic field which includes a line deflection component and a field deflection component, the deflection yoke means comprising a plurality of electrical coils arranged such that the line deflection component is formed and the field deflection component is formed transverse to said line deflection component, the deflection yoke means further including at least one conducting plate having a length and having a rear end and a front end wherein said at least one conducting plate further comprises an opening having an increasing angular width from said front end to said rear end wherein said at least one conducting plate enhances a pin cushion shape of said magnetic field at the rear end of the at least one conducting plate and wherein said at least one conducting plate enhances a barrel shape of said magnetic field at the front end of the at least one conducting plate when said at least one conducting plate is electrically energized.

11. An apparatus for displaying video images, the apparatus comprising:

a vacuum envelope having a neck portion and a display screen and having a electron gun system for producing at least one electron beam wherein, in response to a magnetic field, said at least one electron beam converges onto the display screen causing video images corresponding to the converged at least one electron beam to be displayed thereon; and deflection yoke means for producing, when electrically energized, said magnetic field, the deflection yoke means comprising at least one conducting plate having a length and having a rear end and a front end wherein said at least one conducting plate are shaped to substantially conform to a shape of the neck portion of the vacuum envelope wherein said at least one conducting plate further includes at least one slot oriented transverse to the length of said at least one conducting plate.

12. An apparatus for displaying video images, the apparatus comprising:

a vacuum envelope having a neck portion and a display screen and having a electron gun system for producing at least one electron beam wherein, in response to a magnetic field, said at least one electron beam converges onto the display screen causing video images corresponding to the converged at least one electron beam to be displayed thereon; and deflection yoke means for producing, when electrically energized, said magnetic field, the deflection yoke means comprising at least one conducting plate having a length and having a rear end and a front end wherein said at least one conducting plate are shaped to substantially conform to a shape of the neck portion of the vacuum envelope wherein said at least one conducting plate further includes two slots, a first slot positioned near the rear end of said at least one conducting plate and a second slot positioned near the front end of said at least one conducting plate and wherein said first slot and said second slot are each oriented transverse to the length of said at least one conducting plate.

13. An apparatus for displaying video images, the apparatus comprising:

a vacuum envelope having a neck portion and a display screen and having a electron gun system for producing at least one electron beam wherein, in response to a magnetic field, said at least one electron beam converges onto the display screen causing video images corresponding to the converged at least one electron beam to be displayed thereon; and deflection yoke means for producing, when electrically energized, said magnetic field, the deflection yoke means comprising at least one conducting plate which are shaped to substantially conform to a shape of the neck portion of the vacuum envelope wherein said at least one conducting plate includes a plurality of apertures, said plurality of apertures including a slot in said at least one conducting plate, the slot extending a distance along a length of said at least one conducting plate.

14. An apparatus for displaying video images, the apparatus comprising:

a vacuum envelope having a neck portion and a display screen and having a electron gun system for producing at least one electron beam wherein, in response to a magnetic field, said at least one electron beam converges onto the display screen causing video images corresponding to the converged at least one electron beam to be displayed thereon; and deflection yoke means for producing, when electrically energized, said magnetic field, the deflection yoke means comprising at least one conducting plate having a length and having a rear end and a front end wherein said at least one conducting plate are shaped to substantially conform to a shape of the neck portion of the vacuum envelope wherein said at least one conducting plate comprises an opening the opening having an increasing angular width from said front end to said rear end.

15. An apparatus for displaying video images, the apparatus comprising:

a vacuum envelope having a neck portion and display screen and having a electron gun system for producing at least one electron beam wherein, in response to a magnetic field, said at least one electron beam converges onto the display screen causing video images corresponding to the converged at least one electron beam to be displayed thereon; and deflection yoke means for producing, when electrically energized, said magnetic field, the deflection yoke means comprising at least one conducting plate having a length and having a rear end and a front end wherein said at least one conducting plate are shaped to substantially conform to a shape of the neck portion of the vacuum envelope wherein said at least one conducting plate includes an opening, the opening having an increasing angular width from said front end to said rear end wherein a pin cushion shape of said magnetic field becomes enhanced at the rear end of the at least one conducting plate and a barrel shape becomes enhanced at the front end of the at least one conducting plate.

16. An apparatus for displaying video images, the apparatus comprising:

a vacuum envelope having a neck portion and a display screen and having a electron gun system for producing at least one electron beam wherein, in response to a magnetic field, said at least one electron beam converges onto the display screen causing video images corresponding to the converged at least one electron beam to be displayed thereon; and deflection yoke means for producing, when electrically energized, said magnetic field, the deflection yoke means comprising at least one conducting plate wherein said at least one conducting plate includes two sets of conducting plates, a first set of at least one conducting plate and a second set of at least one conducting plate, wherein said first and second sets of at least one conducting plates are arranged radially about the neck portion of the vacuum envelope such that said first set of at least one conducting plate is arranged in a substantially opposing radial position to that of said second set of at least one conducting plate wherein said first set of conducting plates further comprises a first plurality of conducting plates stacked on each other, each of said first plurality of conducting plates separated from each other by an electrical insulator and said second set of conducting plates comprises a second plurality of conducting plates stacked on each other, each of said second plurality of conducting plates separated from each other by an electrical insulator.

17. An apparatus as in claim 16 wherein said first set of conducting plates are shaped to substantially conform to the shape of said neck portion of the vacuum envelope and said second set of conducting plates are shaped to substantially conform to the shape of said neck portion of the vacuum envelope.

18. An apparatus for shaping magnetic deflection fields in cathode ray tubes comprising:

a plate of conducting material having a length and having a rear end and a front end contoured to fit onto said cathode ray tube and at least one magnetic field shaping feature wherein said magnetic field shaping feature comprises two slots, a first slot positioned near the rear end and a second slot positioned near the front end and wherein said first slot and said second slot are each oriented transverse to said length of said plate of conducting material.

19. An apparatus for shaping magnetic deflection fields in cathode ray tubes comprising:

a plate of conducting material having a length and having a rear end and a front end contoured to fit onto said cathode ray tube and at least one magnetic field shaping feature wherein said magnetic field shaping feature comprises an opening having an angular width from said front end to said rear end in said plate of conducting material.

20. An apparatus as in claim 19 wherein said opening having an increasing angular width from said front end to said rear end is shaped to enhance a pin cushion shape a magnetic field at the rear end of the plate and shaped to enhance a barrel shape of said magnetic field at the front end of the plate.

* * * * *